US007237624B2

(12) United States Patent
Chau et al.

(10) Patent No.: US 7,237,624 B2
(45) Date of Patent: Jul. 3, 2007

(54) ELECTRONIC ROLL INDEXING COMPENSATION IN A DRILLING SYSTEM AND METHOD

(75) Inventors: Albert W. Chau, Woodinville, WA (US); Honggi Tian, Bellevue, WA (US)

(73) Assignee: Merlin Technology, Inc., Kent, WA (US)

( * ) Notice: Subject to any disclaimer, the term of this patent is extended or adjusted under 35 U.S.C. 154(b) by 302 days.

(21) Appl. No.: 10/939,063

(22) Filed: Sep. 9, 2004

(65) Prior Publication Data

US 2006/0048970 A1 Mar. 9, 2006

(51) Int. Cl.
*E21B 47/02* (2006.01)
*E21B 7/06* (2006.01)

(52) U.S. Cl. ..... 175/45; 175/74

(58) Field of Classification Search ..... 175/45, 175/74

See application file for complete search history.

(56) References Cited

U.S. PATENT DOCUMENTS 5,182,516 A * 1/1993 Ward et al. ..... 324/326
5,265,682 A * 11/1993 Russell et al. ..... 175/45
5,439,064 A * 8/1995 Patton ..... 175/24
5,880,680 A * 3/1999 Wisehart et al. ..... 340/853.4
6,223,826 B1 5/2001 Chau et al.
6,446,728 B2 9/2002 Chau et al.
6,496,008 B1 12/2002 Brune et al.
6,655,464 B2 12/2003 Chau et al.
6,705,415 B1 3/2004 Falvey et al.
2002/0112887 A1* 8/2002 Harrison ..... 175/27
2003/0076106 A1* 4/2003 Mercer ..... 324/326
2004/0089474 A1* 5/2004 Noureldin et al. ..... 175/45
2004/0089475 A1* 5/2004 Kruspe et al. ..... 175/45

OTHER PUBLICATIONS

Cavo Drilling Motors, Motor Operations Manual, 2003, Cavo Drilling Motors, Houston Texas.

* cited by examiner

*Primary Examiner*—Jennifer H. Gay
*Assistant Examiner*—David Andrews
(74) *Attorney, Agent, or Firm*—Pritzkau Patent Group, LLC

(57) ABSTRACT

An assembly is configured for sensing its roll orientation, referenced to a roll indexing orientation that is defined by the assembly, so as to produce a roll output signal and for transmitting the roll output signal in a predetermined way. A housing is configured to support the assembly for fixedly co-rotating the assembly with the leading arrangement such that the roll indexing orientation is in a fixed angular offset with respect to any given roll position of the leading arrangement, which fixed angular offset is arbitrarily established between the housing and the leading arrangement. A roll compensation value is established that is a constant in view of the fixed angular offset. In one feature, the roll output signal is received with the steering configuration of the leading arrangement oriented in a particular way, for identifying a corresponding value of the fixed angular offset.

53 Claims, 8 Drawing Sheets

ELECTRONIC ROLL INDEXING COMPENSATION IN A DRILLING SYSTEM AND METHOD

BACKGROUND OF THE INVENTION

The present invention is related generally to the field of directional drilling and, more particularly, to electronic roll indexing compensation in a directional drilling system and method.

Drilling systems generally use a drill string which extends from a drill rig, positioned at the surface of the ground, to an inground boring tool or downhole arrangement which is connected to a foremost end of the drill string. The specific configuration of the downhole arrangement may vary substantially, depending on the specific type of drilling operation that is being performed. Generally, however, directional drilling utilizes some form of downhole assembly which allows for steering the drill head in a controlled manner. In one configuration, the downhole arrangement includes a drill head having an asymmetric face. So long as the drill string is rotated continuously, a straight borehole is formed, assuming uniform soil conditions. In order to steer the drill head, the asymmetric face is oriented in a desired position while the drill string is extended, thereby causing the asymmetric face to produce a lateral force which deviates the borehole. In another configuration, the drill arrangement utilizes a "bent sub" connected to the foremost end of the drill string, which may also be referred to as a "bend sub." The bent sub is generally attached on one side to the drill string and on the other side to a mud motor which rotates a drill bit which is powered using mud that is pumped down the drill string from the drill rig under considerable pressure. The bent sub provides a slight angular offset of the downhole arrangement with respect to the overall axis of the drill string for purposes of steering. That is, when the bent sub is oriented in a particular direction, using the drill string, for a period of time as the drill string is extended, the angular offset of the bent sub causes the borehole to be deviated in that particular direction. Formation of a straight borehole, using a bent sub, is provided using appropriate rotation of the drill string.

As is evident from the foregoing discussions, directional drilling requires an awareness of the orientation of the steering mechanism at the inground end of the drill string. In the past, various approaches have been used in order to provide this awareness. With respect to drilling arrangements which utilize an asymmetric drill head, it should be appreciated that a roll orientation signal can be transmitted from a transmitter that is located in the drill head itself, such that the transmitter co-rotates with the drill head. In such an arrangement, simple mechanical expedients may be used such as, for example, indexing tabs so as to index a zero roll position of the transmitter with the asymmetric face of the drill head. In other forms of drilling arrangements such as, for example, those using a bent sub, considerably more complex approaches have been necessary in the prior art to index the transmitter to the steering mechanism, as will be described immediately hereinafter.

It should be appreciated that a typical bent sub arrangement including a mud motor is generally incapable of carrying a transmitter within the mud motor itself. This result generally obtains since the mud motor is a relatively complex and long assembly having a central rotating drive shaft which rotates the drill bit. A mechanical indexing arrangement for a transmitter is therefore difficult to provide since the transmitter is generally located in the drill string behind the mud motor and the bent sub. Moreover, there will generally be a threaded connection between the drill string, that supports the transmitter, and the bent sub. This threaded connection produces an arbitrary roll orientation therebetween. Accordingly, mechanical indexing arrangements, in the presence of a bent sub or mechanically similar arrangement, tend to be quite complex in order to appropriately index the transmitter zero roll orientation to the steering direction of the bent sub.

The present invention provides an electronic roll indexing arrangement and method which resolves the foregoing difficulties and concerns while providing still further advantages.

SUMMARY OF THE DISCLOSURE

As will be discussed in more detail hereinafter, there is disclosed herein an apparatus and associated method used in a system for forming a borehole including a drill string which is made up of a series of elongated sections that is connected to a leading arrangement having a steering configuration that is responsive to a roll position thereof, which roll position is controlled using the drill string. In one aspect of the present invention, an assembly is provided that is configured for sensing a roll orientation thereof, referenced to a roll indexing orientation that is defined by the assembly, so as to produce a roll output signal and for transmitting the roll output signal in a predetermined way. A housing is configured to support the assembly in relation to the drill string behind the leading arrangement in fixed rotational communication with the leading arrangement such that the roll indexing orientation is in a fixed, but arbitrary angular offset with respect to the roll position of the leading arrangement. With the assembly supported in the housing, the roll position of the steering configuration is oriented in a predetermined way. The roll output signal is received, with the steering configuration of the leading arrangement oriented in the predetermined way, for use in identifying a value of the fixed angular offset. The value of the fixed angular offset can then be saved.

In another aspect of the present invention, in which an apparatus and associated method are used in a system for forming a borehole including a drill string which is made up of a series of elongated sections that is connected to a leading arrangement having a steering configuration that is responsive to a roll position thereof, which roll position is controlled using the drill string, an assembly is configured for sensing a roll orientation thereof, referenced to a roll indexing orientation that is defined by the assembly, so as to produce a roll output signal and for transmitting the roll ouput signal in a predetermined way. A housing is configured to support the assembly for fixedly co-rotating the assembly with the leading arrangement such that the roll indexing orientation is in a fixed angular offset with respect to any given roll position of the leading arrangement, which fixed angular offset is arbitrarily established between the housing and the leading arrangement. A roll compensation value is established that is a constant in view of the fixed angular offset. The roll compensation value can then be saved.

BRIEF DESCRIPTIONS OF THE DRAWINGS

The present invention may be understood by reference to the following detailed description taken in conjunction with the drawings briefly described below.

FIGS. 13*a*–*d* are diagrammatic illustrations of a display screen which may form part of a portable device, shown here to illustrate its operation and the display of roll parameters with respect to the display and selection of unmodified and modified roll display modes.

DETAILED DESCRIPTION

Figure 1:
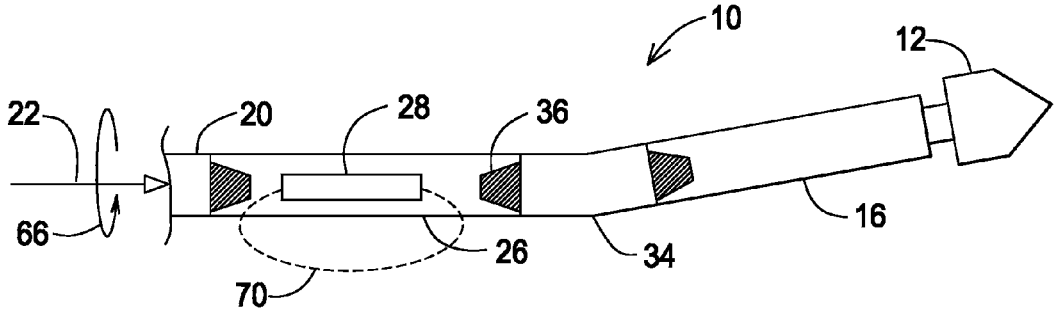
FIG. 1 is a diagrammatic view, in elevation, of one embodiment of a downhole arrangement that is produced in accordance with the present invention.

Turning now to the figures, in which like reference numbers are used to refer to like items whenever possible throughout the various figures, attention is immediately directed to FIG. 1 which illustrates a downhole drilling arrangement produced in accordance with the present invention and generally indicated by the reference numeral 10. It is noted that the figures are diagrammatic for purposes of enhancing the reader's understanding. Further, the drawings are not to scale for purposes of better illustrating features that are of interest. Moreover, terminology such as, for example, behind/ahead, vertical/horizontal, left/right and up/down is used for descriptive purposes only and is in no way intended as being limiting.

Still referring to FIG. 1, arrangement 10 includes a drill bit 12 which is rotated, for example, by a mud motor (not shown) contained by a mud motor section 16. It is noted that such mud motors are well-known to those having ordinary skill in the art. The mud motor is often hydraulically operated using drilling mud that is pumped down a drill string 20 (only partially shown) in a direction indicated by an arrow 22 from a drill rig (not shown) operating at the surface of the ground. The drill string is typically assembled in sections as drilling progresses, using mated drill pipe sections having what are commonly referred to as threaded "box" and "pin" connections. A leading end of the drill string supports a transmitter housing 26 which is configured for containing a transmitter 28 therein, as will be described in further detail hereinafter.

A bent sub 34 is used to connect transmitter housing 26 to mud motor section 16 in order to provide a slight lateral angular offset with respect to the overall drill string for steering purposes, as is described above. It is noted that the lateral angular offset has been exaggerated in the present figure for illustrative purposes. The lateral angular offset provides for steering the drilling operation by orienting the drill bit, responsive to the lateral angular offset, to proceed in a desired direction. Unfortunately, a box and pin fitting set 36 is introduced between transmitter housing 26 and mud motor 16. Box and pin fitting set 36 presents a problem with respect to the fact that this fitting arrangement will not seat in a predictable angular orientation, such that, for any given rotational orientation of transmitter 28, the roll orientation of bent sub 34 is arbitrary, as will be further described immediately hereinafter.

Figure 2:
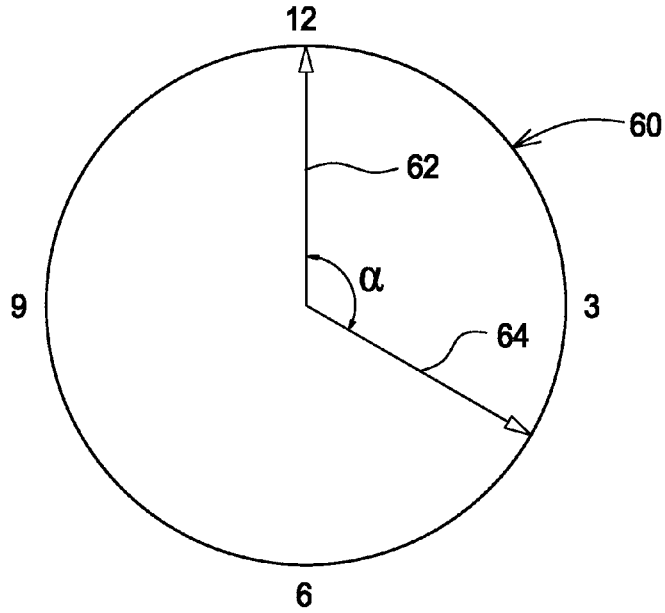
FIG. 2 is a diagrammatic view of an orientation system in a clock face format, shown here to illustrate an angular positional relationship between a roll orientation of the steering configuration and the transmitter initially shown in FIG. 1.

Referring to FIG. 2, a diagrammatic end view illustrates a clock face 60 in which the bent sub is oriented at 12 o'clock as indicated by an arrow 62. An arrow 64 illustrates an arbitrary orientation of a reference or indexing orientation of the transmitter such that an angle $\alpha$ represents an angular offset between the orientation of the bent sub and the reference or indexing orientation of the transmitter. The transmitter indexing orientation represents a roll orientation of the transmitter at which it outputs a zero roll value. Thus, in the present example, the transmitter will indicate a roll orientation of approximately 4 o'clock, even though the bent sub steering direction is at 12 o'clock.

FIG. 1, likewise illustrates the bent sub in a 12 o'clock orientation. In this regard, it is noted that any suitable nomenclature may be used for characterizing angular orientation including the use of degrees, measured from any suitable reference. As described above, maintaining any given orientation of the bent sub over time during drilling causes a deviation of the borehole in the direction of the given orientation. Rotation of the drill string in a continuous manner, indicated by an arrow 66, results in the formation of a generally straight borehole, at least in the presence of homogeneous soil conditions. Accordingly, it is important for an operator to be aware of the roll orientation with respect to steering. It is to be understood, however, that the present invention is not limited to use with bent sub type downhole assemblies and may be used in any situation where there is a need to correlate the roll position of a leading portion of the downhole assembly with the roll orientation of a transmitter that is spaced away or separated from the leading portion in a way which may introduce an angular roll offset of an arbitrary, but constant nature between the leading portion of the downhole assembly and the transmitter. Moreover, complex mechanical indexing configurations, for referencing the transmitter roll, for example, to a sloped drill face, may be eliminated in favor of the approach of the present invention.

Again directing attention to transmitter 28, this transmitter may be configured in one form for emanating an electromagnetic field 70 such as, for example, a dipole field. Various information may be impressed upon the electromagnetic field or such information may be carried to an aboveground location in other suitable ways. Digital and/or analog information can be modulated on the electromagnetic field or the field may be switched on and off appropriately to transmit the desired information. Information can be transmitted up the drill string, for example, using mud pulsing or using wire-in-pipe arrangements for sending electrical signals (analog and/or digital) up the drill string to the drill rig for use aboveground. While the information of interest can include different types of orientation information, as well as information relating to the operation of the transmitter such as, for example, temperature and battery condition, the specific operational parameter that is of interest here is the roll orientation of the transmitter.

In the instance of transmitting digitally encoded roll information, any suitable programmable receiver may be used to receive the information. One example of such a receiver, in the form of a portable walkover detector, is given in U.S. Pat. No. 6,496,008 (hereinafter the '008 patent) which is commonly owned with the present application and is incorporated herein by reference. FIG. 1 of the '008 patent illustrates a programmable receiver which may receive and decode roll orientation information. Of course, a receiver may be positioned at the drill rig having a connection to a wire-in-pipe arrangement, or mud pulsing arrangement, such that the roll orientation information is transferred up the drill string for use at the drill rig. Alternatively, the roll orientation information can be telemetered from the drill rig for display or use at other locations. Useful wire-in-pipe arrangements are described in U.S. Pat. Nos. 6,223,826, 6,446,728 and 6,655,464, all of which are commonly owned with the present application and incorporated herein by reference.

Figure 3:
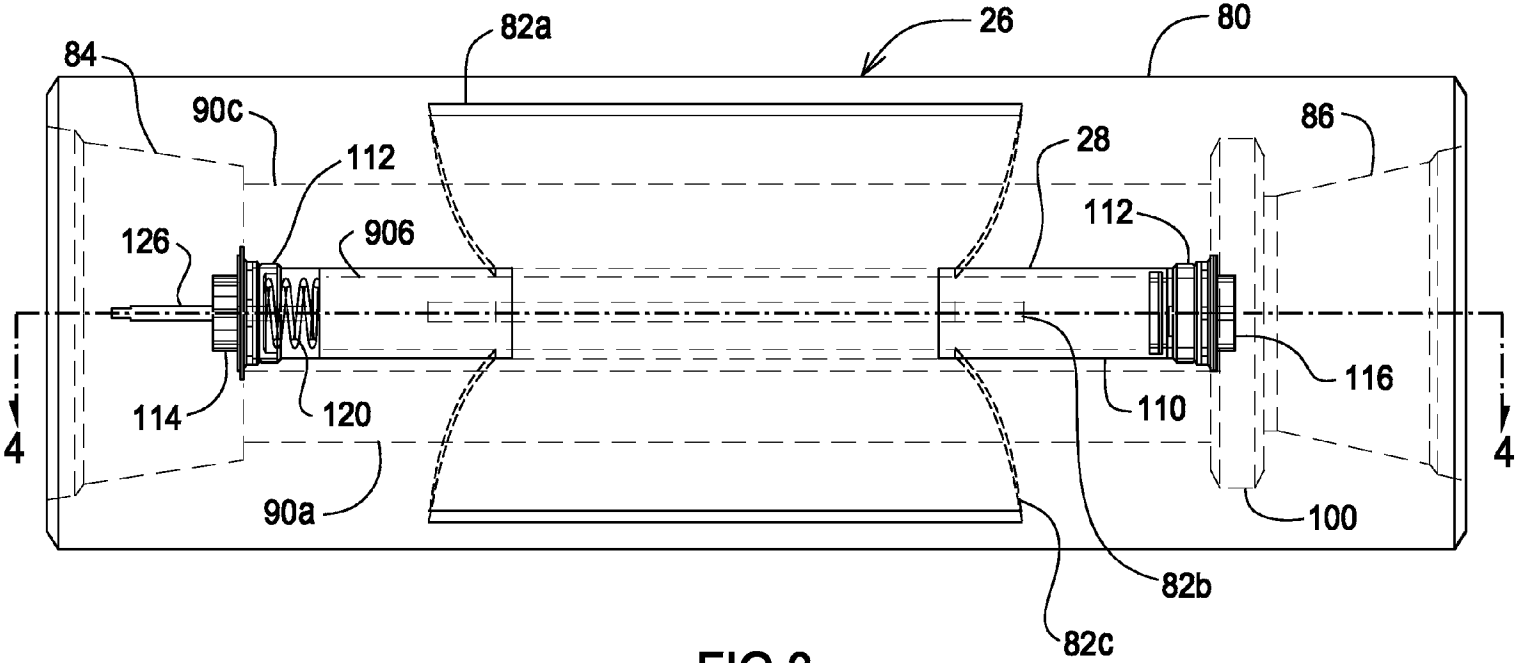
FIG. 3 is a diagrammatic elevational view of one embodiment of a housing having a transmitter supported therein according to the present invention, wherein the housing walls are shown as being transparent for illustrative purposes.

Referring now to FIG. 3, details will now be provided with respect to one configuration of transmitter housing 26. The latter includes a housing or shell 80 which may be formed from suitable materials such as, for example, ANSI 4140, Monel K500. Housing 80 is illustrated as being transparent for illustrative purposes in a diagrammatic side view to show three slots 82*a–c* that may be defined therein for purposes of emanating an electromagnetic signal (see FIG. 1) from transmitter 28, in the instance where such a signal is used. At least an outer portion of each slot is sealed with a suitable material (not shown) that allows transmission of the electromagnetic field therethrough. Such sealing materials include, for example, epoxy. It is understood that the use of three equi-angularly distributed slots represents only one of a number of possible slot configurations which may be defined by the housing. The housing further defines first and second opposing box fittings 84 and 86, respectively, for engaging the drill string and bend sub, respectively (see FIG. 1). It should be appreciated that box fittings 84 and 86 may be of different configurations, as illustrated, to accommodate pin fittings of any particular drill string and/or bent sub. It is noted that box fitting 86 forms part of fitting set 36 of FIG. 1.

Figure 4:
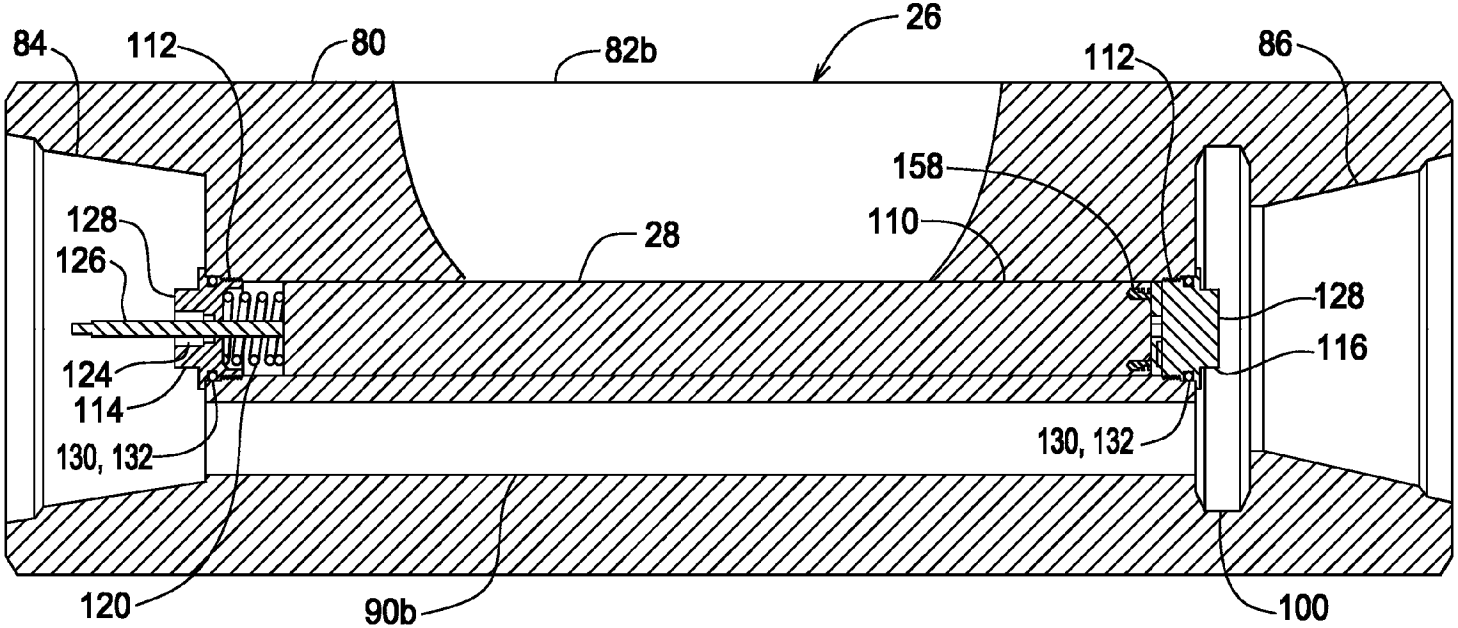
FIG. 4 is a diagrammatic view, in cross-section, of the housing of FIG. 3, shown here to illustrate further details with respect to its construction and the transmitter therein.

Referring to FIG. 4 in conjunction with FIG. 3, the former is a diagrammatic cross-sectional view taken generally along a line 4—4 in FIG. 3. Housing 80 defines a plurality of mud passages 90*a–c*, equi-angularly distributed about an elongation axis of housing 80 for use in transferring drilling mud from the drill string to the mud motor or drill bit. As seen in the view of FIG. 4, with respect to slot 82*b* and mud passage 90*b*, each mud passage is arranged opposite each slot with respect to the elongation axis of the housing.

Figure 5:
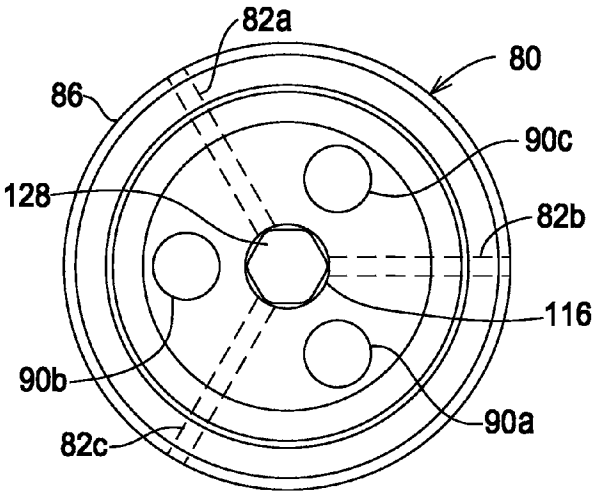
FIG. 5 is a diagrammatic end view of one end of the housing of FIGS. 3 and 4, shown here to illustrate further details with respect to its structure.

Referring to FIGS. 4 and 5, the latter provides a diagrammatic end view of housing 80 looking at box fitting 86 to further illustrate the relationship between slots 82 and mud passages 90. Mud passages 90 lead into each of the box fittings at either end of housing 80. It is noted that box fitting 86 includes an enlarged annular mud receiving region 100 (see FIGS. 3 and 4) as a result of the relatively reduced diameter of box fitting 86 for attachment to the bend sub.

Referring to FIGS. 3 and 4, a transmitter receiving passage 110 is axially centered within shell 84 for receiving transmitter 28. Opposing entrance openings of passage 110 include an inside thread 112 to engage first and second threaded plugs 114 and 116, respectively, as will be further described immediately hereinafter.

Figure 6:
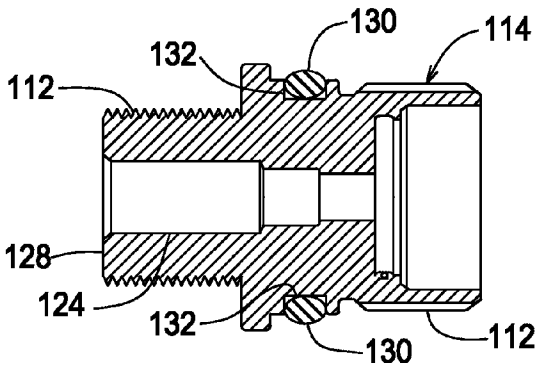
FIG. 6 is a partially cut-away diagrammatic cross-sectional view of one end of the housing of FIGS. 3–5, shown here to illustrate details with respect to a first plug that engages one end of the housing and the transmitter supported therein.

Referring to FIGS. 3, 4, and 6, with transmitter 28 in its installed configuration within housing 80, end plug 114 threadingly engages passage 110 in a way which captures a helical coil biasing spring 120 between transmitter 28 and end plug 114. FIG. 6 is a cross-sectional view of end plug 114 which illustrates a through passage 124 defined therein. This through passage can be provided for accommodating an electrical conductor 126 (see FIGS. 3 and 4) for connection to a wire-in-pipe arrangement. Wire 126 may be sealed against the interior of passage 124 in any suitable manner such as, for example, using a plug (not shown) with an 0-ring to form a compression seal around the insulation of the electrical wire. Of course, through passage 124 may be eliminated in the instance of transmitting the roll and other information using an electromagnetic signal. Likewise, where a wire-in-pipe transmission arrangement is used, slots 82 may be eliminated. Plug 114, like plug 116, includes a hex head 128 for use in installing each of the plugs, although any suitable configuration can be used for this purpose. An O-ring 130 is received in an O-ring groove 132 that is defined by the plug body. O-ring 130 sealingly engages an interior sidewall of passage 110 peripheral to the entrance into the passage at either end from box fittings 84 and 86.

Figure 7:
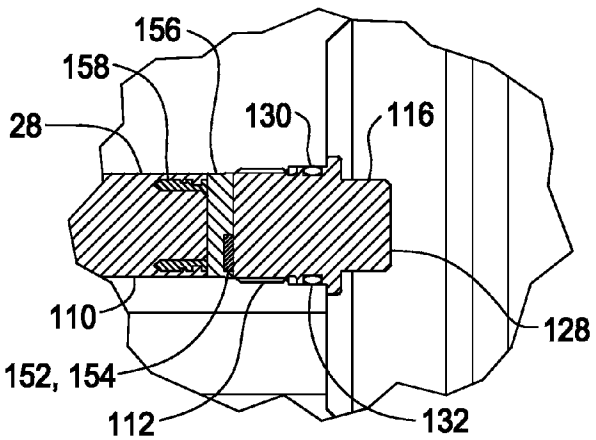
FIG. 7 is a diagrammatic cross-sectional view of a second plug that engages the other end of the housing and the transmitter therein including an angular indexing arrangement which fixes the angular orientation of the transmitter with respect to the housing.
Figure 8:
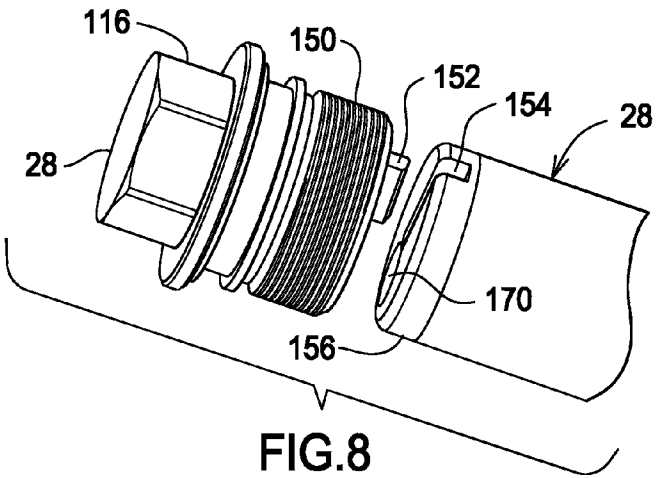
FIG. 8 is a diagrammatic view, in perspective, of the second plug of FIG. 7, shown here to illustrate further details with respect to the angular indexing arrangement.

Turning to FIGS. 7 and 8 in conjunction with FIGS. 3 and 4, plug 116 will now be described in further detail. FIG. 7 provides an enlarged cross-sectional view of plug 116 installed within passage 110 and positioned against one end of transmitter 28. FIG. 8 illustrates plug 116 in relation to a corresponding end of transmitter 28 in an enlarged perspective view. As seen through the combination of FIGS. 4 and 8, plug 116, like plug 114, includes an outer thread 150 for engaging inner thread 112 of passage 110 in housing 80. FIGS. 7 and 8 further illustrate an alignment tab 152 which extends outwardly from the body of plug 116. Alignment tab 152 is configured to engage a slot 154 which is defined by an end cap 156 of transmitter 28. Generally, alignment slot 154 defines the reference indexing and zero roll orientation of the transmitter. End cap 156 is installed in the elongated body of transmitter 28, at least in part, using capture fingers 158 that are seen in FIGS. 4 and 7. Installation of transmitter 28 within housing 80 can be accomplished by first installing plug 114 and biasing spring 120 within housing 80. Transmitter 28 is then slidingly received in passage 110 to engage biasing spring 120. Thereafter, end plug 116 is installed in the opposing end of passage 110. As end plug 116 is rotated, alignment tab 152 is received within slot 154 of the transmitter to, thereafter, co-rotate with the end plug. Plug 116 is then seated against housing 80 at box end 86 so as to effectively "lock" the transmitter in position rotationally with respect to housing 80. Accordingly, transmitter 28 is resiliently captured between spring 120 and end plug 116 in a fixed rotational orientation which itself is arbitrary with respect to the housing. What is important, however, is that this orientation, even though arbitrary, is fixed and will not vary when the housing and transmitter therein are exposed to potential underground conditions. In this regard, it should be appreciated that the relationship between the housing and the mud motor, shown in FIG. 1, is also fixed, but arbitrary. Accordingly, the overall relationship between the transmitter and the steering direction of the mud motor is fixed, but arbitrary. Again, the arbitrary nature of the overall relationship between the transmitter and the steering configuration that is used is not a concern so long as the relationship remains fixed after it is initially established. With brief reference to FIG. 8, it is noted that a circular marking 170 is present at the end of the transmitter adjacent to slot 154. This marking is color-coded and represents an option that is used for purposes of indicating the temperature tolerance of transmitter 28.

Figure 9:
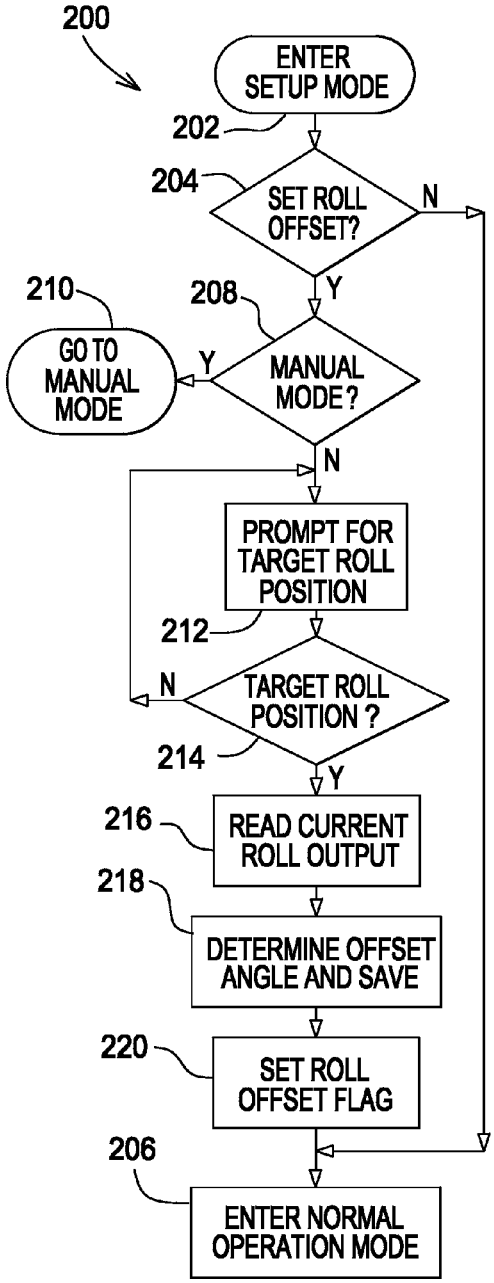
FIGS. 9–12 are flow diagrams which cooperatively illustrate the present invention.

Having described in detail above the physical attributes of the present invention, attention is now directed to its accompanying method. Specifically, FIG. 9 is a flow diagram, generally indicated by the reference number 200 which illustrates a setup mode, forming at least a portion of the method of the present invention, which can be performed using any suitable receiver that is capable of receiving the roll output signal transmitted from transmitter 28, as described above. Such a receiver generally includes a display such as, for example, an LED, LCD, and/or plasma display for presenting information of interest to an operator of the receiver. The receiver usually comprises a portable device such as described, for example, that may be provided on a portable device such as, for example, on the walkover locater that is illustrated in the above incorporated '008 patent. Alternatively, the roll output signal may be received at the drill rig and displayed there and/or a telemetry system may transmit the roll output signal, or related data, to another aboveground location.

Continuing with a description of flow diagram 200, the setup mode is entered at step 202 and proceeds to step 204. In step 204, the receiver provides an option to the operator for entering the setup mode. If the operator elects not to do so, the system reverts to the normal operation mode in step 206. If, however, the operator elects to set the roll offset, step 208 prompts the operator with the option to enter a manual setup mode. If the operator chooses to enter the manual setup mode, execution moves to step 210, thereby initiating the manual setup mode. This mode will be described with reference to a subsequent flow diagram. Where the operator in step 208 elects not to enter the manual mode, operation continues to step 212 which prompts the operator to place the steering configuration into a target roll position. The latter may be any position which is convenient, however, in most instances it should be convenient to orient the steering configuration such as, for example, a bent sub in an upward orientation (i.e., 12 o'clock). With collective reference to FIG. 1, it is noted that this step may be performed so long as at least transmitter 28, housing 26 and bent sub 34 are assembled so as to fix their rotational orientations with respect to one another, although the specific final orientation can be arbitrary. Subsequent connection of mud motor 16 should not affect this fixed rotational orientation, as is likewise the case with respect to attaching drill string 20 to housing 26. Thus, flexibility is provided with respect to the assembly state of the downhole arrangement when this setup is performed.

Having prompted the operator to place the steering configuration into the target roll position, step 214 then queries the operator to ascertain whether the steering configuration is in the target roll position. If not, a loop including steps 212 and 214 is entered until the condition is satisfied. Once it is confirmed by the operator that the steering configuration is in the target roll position, step 216 reads a current roll output based on a current value of the roll output signal from transmitter 28. The current roll output signal is then used in step 218 to determine the offset angle a and this value is saved for future reference. Step 220 then sets a roll offset flag so as to indicate that the system is in an operating mode which invokes the use of the roll offset value whenever a roll position of the steering configuration is to be determined. Normal operation then resumes in step 206. It is noted that the roll offset may be set and cleared in any suitable manner. As one example, a single digital bit may be used wherein a set state is represented by a one while a cleared state can be represented by a zero. Of course, negative logic may be employed wherein these states, with respect to the bit, are reversed.

Figure 10:
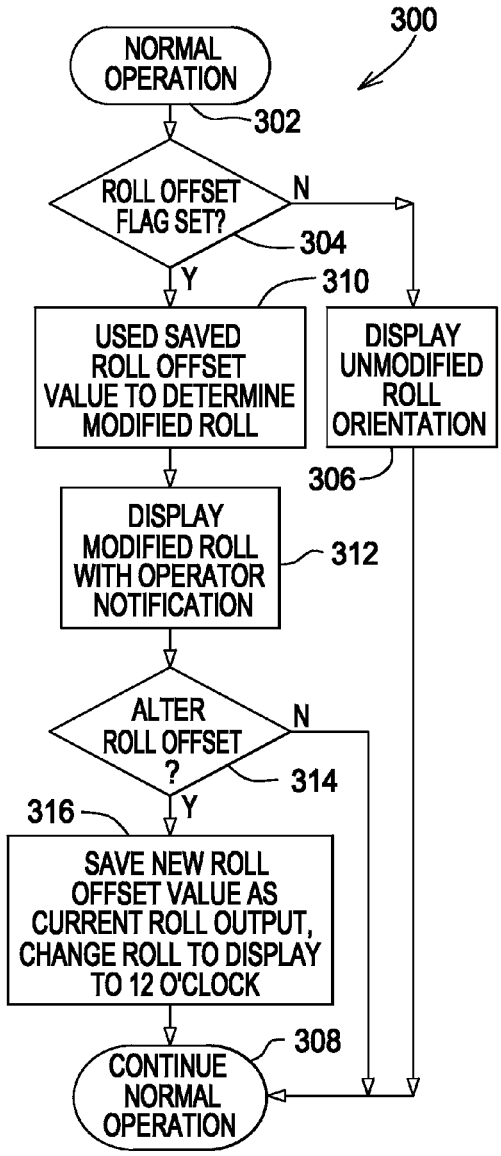

Turning now to FIG. 10, attention is now directed to a portion of the normal operation mode which forms part of the method of the present invention. It is noted that the sequence illustrated is only part of an overall normal operational mode that is of specific interest here. Illustration of the complete overall normal operational mode is beyond the scope of the present discussion since the "sub-process" under discussion may be implemented in any number of different ways and placed at different positions in the context of the overall normal operational mode. This figure comprises a flow diagram that is generally indicated by the reference number 300 and begins at step 302 within the overall normal operational mode. Step 304 then tests the roll offset flag. When the roll offset flag is cleared, operation proceeds to step 306 which causes the display of an unmodified roll orientation. Optionally, an indication may be provided to the operator that the regular or unmodified roll value is in use. This may be referred to, for example, as the "regular roll mode." In essence, the roll orientation of transmitter 28 is displayed. At step 308, the normal operational mode then resumes. Returning to step 304, in the instance when the roll offset flag is set, step 310 then uses the saved roll offset value to determine a current modified roll value in conjunction with a current value of the roll output signal being transmitted by transmitter 28. Step 312 then displays the current modified roll value and, optionally, may provide an indication to the operator that the modified roll indication system is in use. This may be referred to, for example, as the "modified roll mode." Thereafter, step 314 provides an opportunity to the operator to alter the current roll offset value that has been saved. If the prompt is answered in the negative, the normal operation mode resumes at step 308. If, on the other hand, the operator elects to alter the roll offset value, step 316 saves a new roll offset value based on the current roll output signal of transmitter 28. That is, the current roll position of the steering configuration, depending upon the specific nomenclature in use for describing the roll orientation, will become the "home", reference, zero roll position or 12 o'clock position, whenever the modified roll mode is invoked, irrespective of the actual roll position of the steering configuration. The opportunity to alter or adjust the roll offset value is convenient for purposes of providing minor adjustments in order to fine-tune steering or to correct steering bias due to a specific design of the drill bit.

Figure 11:
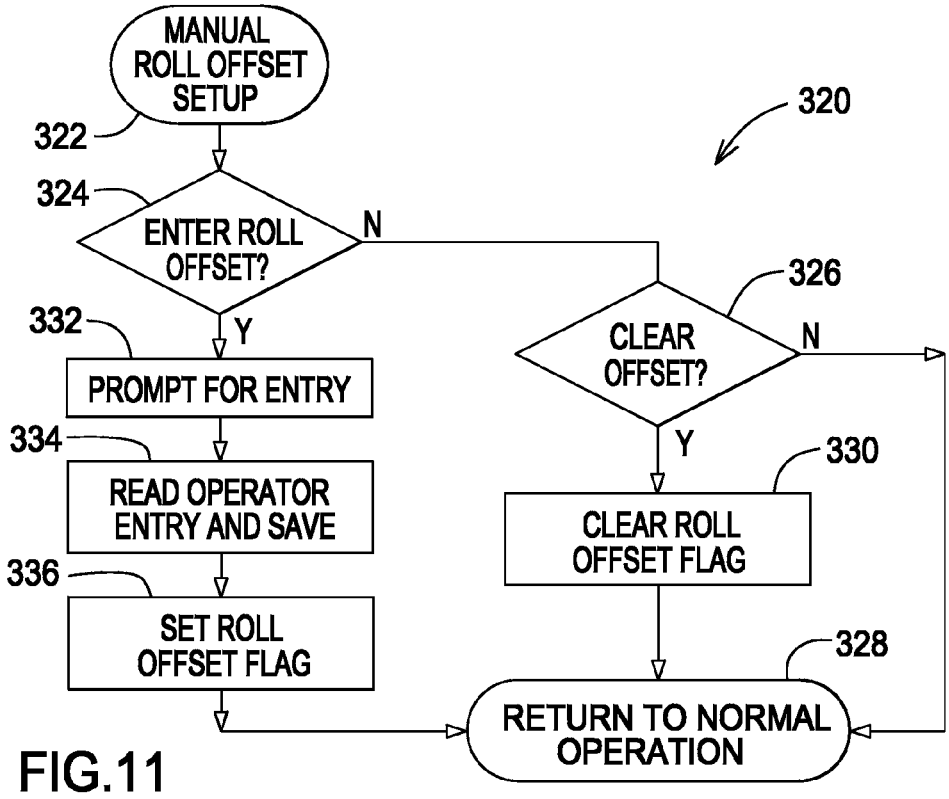

Turning now to FIG. 11, a flow diagram, generally indicated by the reference number 320, illustrates the aforementioned manual roll offset setup mode. This mode is initiated at step 322 and proceeds to step 324 in which the operator is queried for entering a manual roll offset value. If the operator elects not to enter a roll offset value step 326 then determines whether the operator would like to clear the offset value and thereby enter the regular roll mode. If the operator elects not to clear the offset value, step 328 returns the system to normal operation in the modified roll mode. If the operator elects to clear the offset value, step 330 clears the roll offset flag such that normal operation resumes in the regular roll mode. Returning to step 324, if the operator elects to manually enter a roll offset value, step 332 provides a prompt to enter this value. Step 334 reads and saves the operator entered roll value and step 336 then sets the roll offset flag. Normal operation then resumes in step 328 using the modified roll mode.

Figure 12:
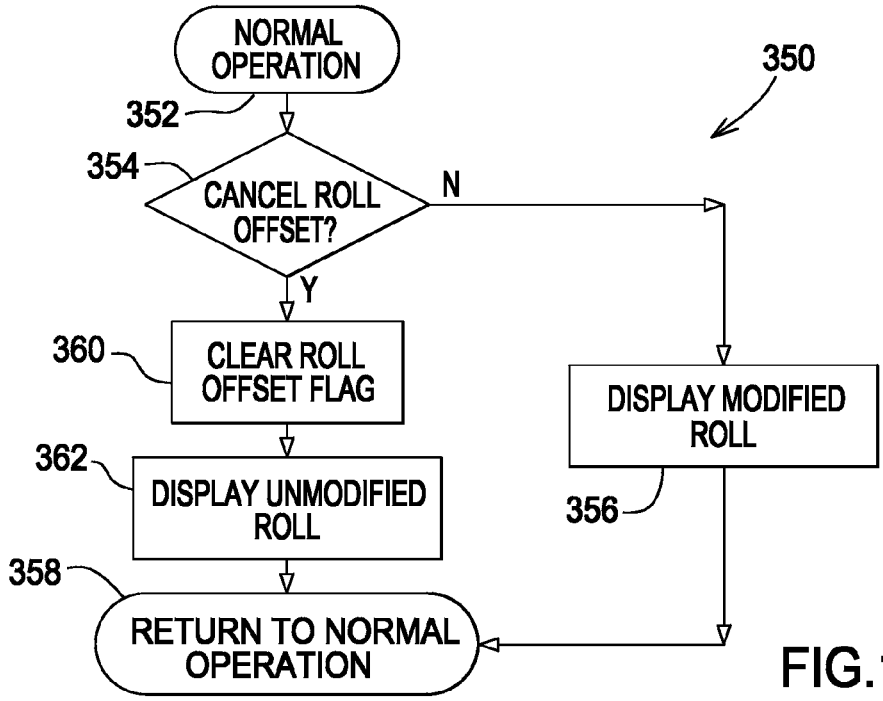

FIG. 12 illustrates a portion of the normal overall operational mode, generally indicated by the reference number 350, for selectively canceling the modified roll mode to thereafter proceed in the regular roll mode. From some suitable point in normal operation, indicated by step 352, execution is passed to step 354 wherein a query determines whether it is desired to cancel the use of the roll offset value, that is, to revert from the modified roll mode to the regular roll mode. If this query is answered in the negative, the modified roll value is displayed thereafter, as required by step 356, when the normal operational mode resumes in step 358. On the other hand, when the query of step 354 is answered in the affirmative, step 360 clears the roll offset flag. Step 362 requires display thereafter of the unmodified roll value. Again, the overall procedure embodied by the flow diagram presently under discussion may be invoked at any suitable point or points within the normal operational mode of the receiver.

FIGS. 13*a–d* are screen shots which illustrate a display, generally indicated by the reference number 400, that may be provided on a portable device such as, for example, the walkover locater that is illustrated in the above incorporated '008 patent. Each figure includes a centered illustration 402 of the locator that is in use in relation to a field defined point 404 which is established in some way through using a particular form of locating signal such as, for example, a dipole field. Each of the subject figures further illustrates a drill head pitch 406 using an appropriate symbol, below which appears a current pitch measurement 408. In the present example, the latter is shown as 2.8% and is indicated as being upward by symbol 406. A signal strength indication 410 is indicated in one corner of display 400. In the present example, the indicated signal strength is "523". The upper right hand corner of display 400 includes a roll indicator 420 in the form of a clock face. It is noted that these various display elements may be reorganized in any appropriate manner or combination, based on a particular application, and the present figures are in no way intended as being limiting.

Figure 13A:
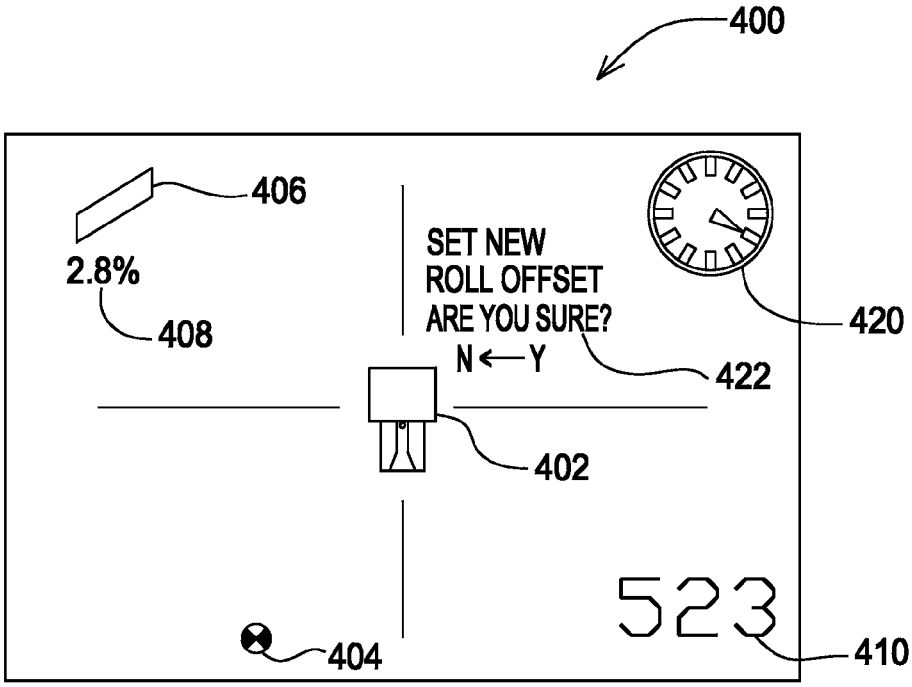

Referring specifically to FIG. 13*a*, a query 422 is being presented to the operator requesting confirmation of an initial request to set a new roll offset. The operator may set a new roll offset by selecting "Y" for yes or may cancel by selecting "N" for no. It is noted that roll indicator 420 is illustrating an actual or uncompensated roll value of 4 o'clock. Of course, if the operator selects "N", the appearance of roll indicator 420 will be unchanged.

Figure 13B:
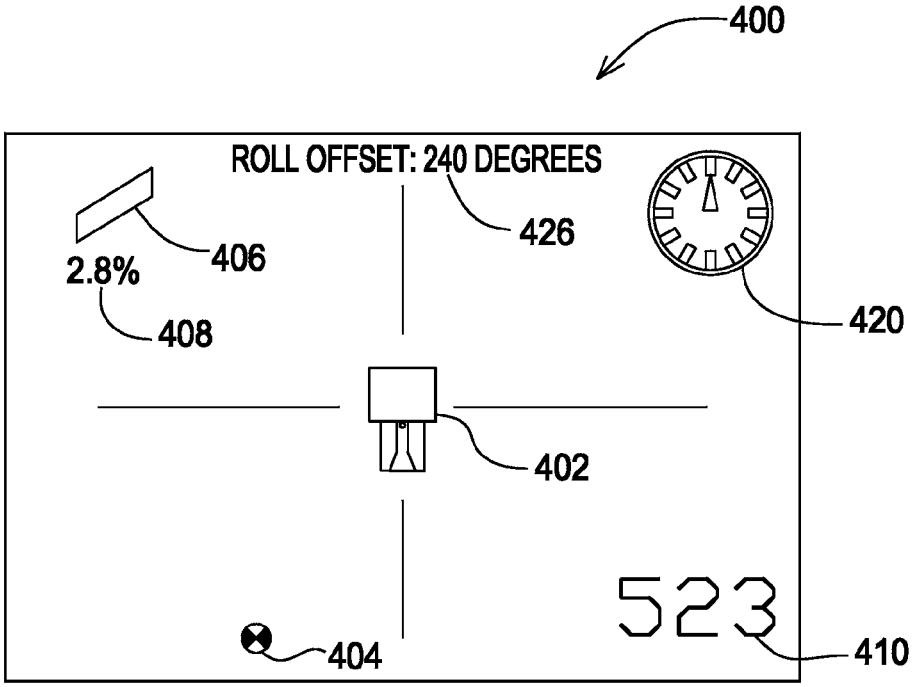

FIG. 13*b* illustrates the appearance of display 400 when "Y" is selected in the display of FIG. 13*a*. Specifically, roll indicator 420 illustrates a modified roll of 12 o'clock. Display 400 then provides a roll offset notification 426 which indicates that modified roll is in use and that the offset value is 240 degrees, measured clockwise from 12 o'clock. Notification 426 serves to continually remind an operator that roll offset is currently in use, although such notification could be provided intermittently and is not a requirement.

Figure 13C:
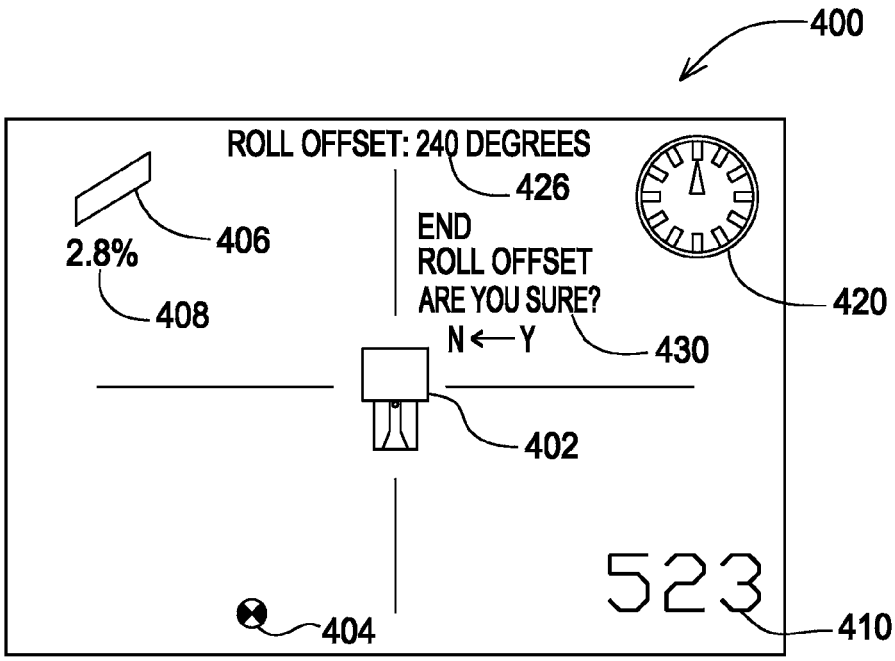

FIG. 13*c* illustrates the appearance of display 400 including a query 430 which is presented to the operator. If the operator, selects "N" (for "No"), the query disappears and the roll offset will remain at 240 degrees such that roll indicator 420 shows the modified roll orientation value.

Figure 13D:
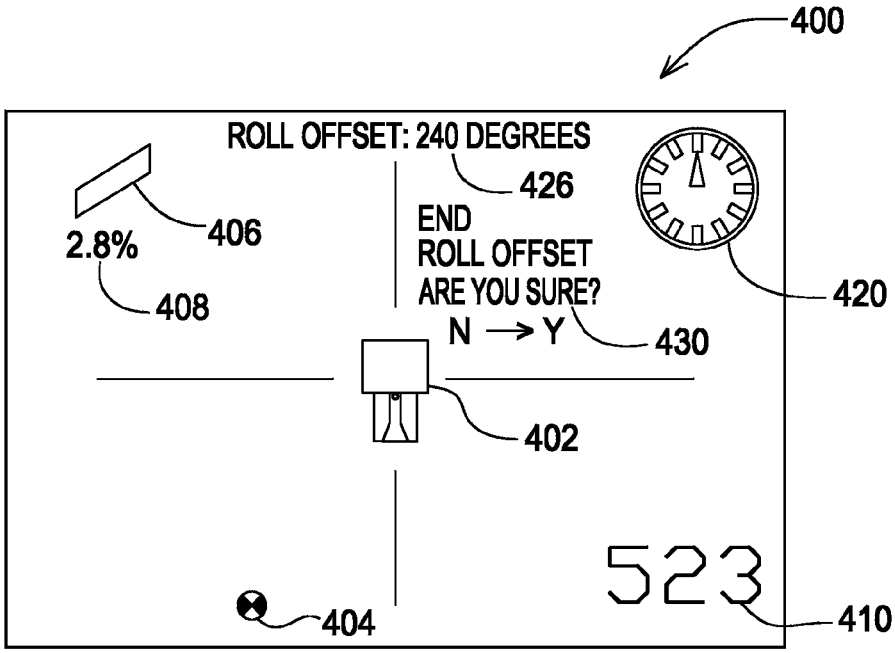

FIG. 13*d* illustrates the appearance of display 400 still including query 430. If the operator selects "Y" (for "Yes", roll offset ends and notification 426 disappears along with query 430.

Having described the present invention in detail above, it is worthwhile to note that the described approach is considered to provide an elegant, highly practical and reliable solution to the problem of roll orientation indexing, as discussed above with respect to the prior art. In particular, the need for a mechanically complex and generally expensive mechanical roll indexing arrangement is eliminated.

It is noted that portions of the descriptions herein are presented in terms of symbolic representations of operations on data bits within an electronic device. These descriptions and representations are the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Although each of the aforedescribed physical embodiments have been illustrated with various components having particular respective orientations, it should be understood that the present invention may take on a variety of specific configurations with the various components being located in a wide variety of positions and mutual orientations. Furthermore, the method described herein may be modified in an unlimited number of ways, for example, by reordering, modifying and recombining the various steps. Accordingly, it should be apparent that the arrangements and associated method disclosed herein may be provided in a variety of different configurations and modified in an unlimited number of different ways, and that the present invention may be embodied in many other specific forms without departing from the spirit or scope of the invention. Therefore, the present examples and methods are to be considered as illustrative and not restrictive, and the invention is not to be limited to the details given herein, but may be modified at least within the scope of the appended claims.

What is claimed is:

1. In a system for forming a borehole including a drill string which is made up of a series of elongated sections that is connected to a leading arrangement having a steering configuration that is responsive to a roll position thereof, which roll position is controlled using the drill string, a method comprising:

providing an assembly that is configured for sensing a roll orientation thereof, referenced to a roll indexing orientation that is defined by the assembly, so as to produce a roll output signal and for transmitting said roll output signal in a predetermined way;

configuring a housing to support the assembly in relation to the drill string behind said leading arrangement in fixed rotational communication with the leading arrangement such that the roll indexing orientation is in a fixed, but arbitrary angular offset with respect to the roll position of the leading arrangement;

with said assembly supported in said housing, orienting the roll position of the steering configuration in a predetermined way;

receiving the roll output signal, with the steering configuration of the leading arrangement oriented in said predetermined way, for use in identifying a value of the fixed angular offset; and saving the value of the fixed angular offset.

2. The method of claim 1 including using the value of the fixed angular offset along with a current received value of the roll output signal to determine a current roll position of said steering configuration.

3. The method of claim 1 wherein said leading arrangement includes a mud motor for rotating a drill bit and supporting said assembly between said mud motor and said drill string.

4. The method of claim 3 including further configuring said housing for passing drilling mud from the drill string to the leading arrangement.

5. The method of claim 1 including configuring a receiver for saving the value of said fixed angular offset and for using the receiver to determine a current roll position of said steering configuration based on a current value of the roll output signal and the saved value of the fixed angular offset.

6. The method of claim 5 including configuring said receiver for selectively displaying at least one of the current roll position of the leading arrangement and a current roll orientation of the assembly based, at least in part, on the current value of the roll output signal.

7. The method of claim 6 including presenting a selection menu to an operator using said receiver for providing an operator selection to direct the receiver to determine at least one of the current roll position of the leading arrangement and the current roll orientation of the assembly.

8. The method of claim 1 including configuring said housing to include a first end fitting for connecting with an inground end of said drill string and a second end fitting for connecting with said leading arrangement in which the first end fitting is different from the second end fitting such that the housing adapts the drill string to the leading arrangement while supporting said assembly.

9. The method of claim 1 including arbitrarily establishing said fixed angular offset, at least in part, by threadingly connecting the housing to the leading arrangement.

10. In a system for forming a borehole including a drill string which is made up of a series of elongated sections that is connected to a leading arrangement having a steering configuration that is responsive to a roll position thereof, which roll position is controlled using the drill string, an apparatus comprising:

an assembly that is configured for sensing a roll orientation thereof, referenced to a roll indexing orientation that is defined by the assembly, so as to produce a roll output signal and for transmitting said roll output signal in a predetermined way;

a housing for supporting the assembly in relation to the drill string behind said leading arrangement in fixed rotational communication with the leading arrangement such that the roll indexing orientation is in a fixed, but arbitrary angular offset with respect to the roll position of the leading arrangement; and a receiver for receiving the transmitted roll output signal such that the roll position of the steering configuration can be oriented in a predetermined way while the roll output signal is received for use in identifying a value of the fixed angular offset and for saving the value of the fixed angular offset.

11. The apparatus of claim 10 wherein said receiver is configured for using the value of the fixed angular offset along with a current received value of the roll output signal to determine a current roll position of said steering configuration.

12. The apparatus of claim 11 including configuring said receiver for displaying at least one of the current roll position of the steering configuration and a current roll orientation of the assembly based, at least in part, on the current value of the roll output signal.

13. The apparatus of claim 12 wherein said receiver is configured to present a selection menu to an operator to provide an operator selection for displaying at least one of the current roll position of the steering configuration and the current roll orientation of the assembly.

14. The apparatus of claim 10 wherein said leading arrangement includes a mud motor for rotating a drill bit and wherein said housing supports said assembly between said mud motor and said drill string.

15. The apparatus of claim 14 wherein said housing is configured for transferring drilling mud from the drill string to the leading arrangement.

16. The apparatus of claim 10 wherein said housing is configured to include a first end fitting for connecting with an inground end of said drill string and a second end fitting for connecting with said leading arrangement in which the first end fitting is different from the second end fitting such that the housing adapts the drill string to the leading arrangement while supporting said assembly.

17. The apparatus of claim 10 wherein said fixed angular offset is arbitrarily established, at least in part, by threadingly connecting the housing to the leading arrangement.

18. In a system for forming a borehole including a drill string which is made up of a series of elongated sections that is connected to a leading arrangement having a steering configuration that is responsive to a roll position thereof, which roll position is controlled using the drill string, a method comprising:

providing an assembly that is configured for sensing a roll orientation thereof, referenced to a roll indexing orientation that is defined by the assembly, so as to produce a roll output signal and for transmitting said roll output signal in a predetermined way;

configuring a housing to support the assembly for fixedly co-rotating the assembly with said leading arrangement such that the roll indexing orientation is in a fixed angular offset with respect to any given roll position of the leading arrangement, which fixed angular offset is arbitrarily established between said housing and said leading arrangement;

establishing a roll compensation value that is a constant in view of said fixed angular offset; and saving the roll compensation value.

19. The method of claim 18 wherein establishing the roll compensation value includes configuring a receiver for (i) receiving the roll output signal at a given time, as transmitted in said predetermined way, for use as an offset reference value and (ii) establishing the roll compensation value based at least in part on said offset reference value.

20. The method of claim 18 wherein said roll output signal is received at said given time with the steering configuration at a target roll position, and the roll compensation value is determined using the target roll position in conjunction with said offset reference value.

21. The method of claim 18 wherein transmitting the roll output signal in said predetermined way includes transmitting said roll output signal from said assembly using an electromagnetic signal.

22. The method of claim 18 wherein transmitting the roll output signal in said predetermined way includes transmitting said roll output signal up said drill string to the drill rig.

23. The method of claim 18 including configuring a receiver to receive the roll output signal and prompting an operator of said receiver to selectively manually enter an operator determined value for the roll compensation value and accepting the operator determined roll compensation value.

24. The method of claim 18 including configuring a receiver to receive the roll output signal and to establish said roll compensation value in a procedure which includes (i) prompting an operator to place the leading arrangement into a target roll position, (ii) accepting an operator indication affirming that the leading arrangement is in the target roll position, and (iii) responsive to accepting said operator indication, receiving a current roll output signal and, thereafter, (iv) using the current roll output signal and the target roll position to determine the fixed angular offset.

25. The method of claim 24 wherein said user is prompted to place said leading arrangement in an upward orientation as target roll position.

26. The method of claim 18 including configuring a receiver to receive the roll output signal and setting a roll compensation flag in said receiver responsive to establishing said roll compensation value so that the roll compensation flag changes from a cleared state to set state.

27. The method of claim 26 wherein setting the roll compensation flag then causes the receiver to operate in a modified roll mode such that the roll compensation value is used with any given roll output signal to display a modified roll value.

28. The method of claim 26 including prompting said operator to enter a procedure in which said roll compensation flag can be cleared such that any given roll output signal is thereafter used to display an unmodified roll value which is the roll orientation of said assembly.

29. The method of claim 28 including indicating a current status of the roll compensation flag to an operator of the receiver.

30. The method of claim 29 including indicating at least one of an unmodified roll position of the leading arrangement, when the roll compensation flag is cleared, and a modified roll position of the leading arrangement when the roll compensation flag is set.

31. The method of claim 26 including determining a current roll position of the leading arrangement based on said roll compensation value when said roll compensation flag is in the set state.

32. The method of claim 26 including determining a current roll position of the leading arrangement, as the roll orientation of said assembly, irrespective of said roll compensation value, when said roll compensation flag is in the cleared state.

33. The method of claim 29 including testing said roll compensation flag and, thereafter, responsive to said testing, indicating one of a current roll orientation of the assembly using a current roll output signal or indicating a current roll position of the leading arrangement using the current roll output signal in conjunction with the fixed angular offset.

34. The method of claim 18 including arbitrarily establishing said fixed angular offset, at least in part, by threadingly connecting the housing to the leading arrangement.

35. In a system for forming a borehole including a drill string which is made up of a series of elongated sections that is connected to a leading arrangement having a steering configuration that is responsive to a roll position thereof, which roll position is controlled using the drill string, an apparatus comprising:

an assembly that is configured for sensing a roll orientation thereof, referenced to a roll indexing orientation that is defined by the assembly, so as to produce a roll output signal and for transmitting said roll output signal in a predetermined way;

a housing to support the assembly for fixedly co-rotating the assembly with said leading arrangement such that the roll indexing orientation is in a fixed angular offset with respect to any given roll position of the leading arrangement, which fixed angular offset is arbitrarily established between said housing and said leading arrangement;

a processing section for establishing a roll compensation value that is a constant in view of said fixed angular offset and for saving the roll compensation value.

36. The apparatus of claim 35 wherein said assembly is configured for transmitting the roll output signal in said predetermined way up said drill string to the drill rig.

37. The apparatus of claim 36 wherein said processing section forms part of said drill rig.

38. The apparatus of claim 36 wherein said drill rig is configured for receiving the roll output signal from the drill string and for aboveground re-transmitting of the roll output to a receiver, remotely located from the drill rig, which includes said processing section.

39. The apparatus of claim 35 wherein said processing section forms one portion of a receiver that is further configured for receiving the roll output signal from said assembly.

40. The apparatus of claim 39 wherein said receiver is configured for (i) receiving the roll output signal at a given time, as transmitted in said predetermined way, for use in establishing an offset reference value and (ii) establishing the roll compensation value based at least in part on said offset reference value.

41. The apparatus of claim 40 wherein said roll output signal is received at said given time with the steering configuration at a target roll position, and the roll compensation value is determined using the target roll position in conjunction with said offset reference value.

42. The apparatus of claim 39 wherein said assembly is configured for transmitting the roll output signal in said predetermined way using an electromagnetic signal and said receiver is configured for receiving the electromagnetic signal.

43. The apparatus of claim 35 including a receiver configured to receive the roll output signal and for prompting an operator to selectively manually enter an operator determined value for the roll compensation value and for accepting the operator-determined roll compensation value.

44. The apparatus of claim 35 including a receiver configured to receive the roll output signal and to establish said roll compensation value in a procedure which includes (i) prompting an operator to place the leading arrangement into a target roll position, (ii) accepting an operator indication affirming that the leading arrangement is in the target roll position, and (iii) responsive to accepting said operator indication, receiving a current roll output signal and, thereafter, (iv) using the current roll output signal and the target roll position to determine the fixed angular offset.

45. The apparatus of claim 44 wherein said receiver is configured to prompt the user to place said leading arrangement in an upward orientation as the target roll position.

46. The apparatus of claim 35 including a roll compensation flag maintained by said receiver and the receiver is configured to set the roll compensation flag responsive to establishing said roll compensation value such that the roll compensation flag changes from a cleared state to a set state.

47. The apparatus of claim 46 wherein said receiver responds to setting the roll compensation flag by then operating in a modified roll mode such that the roll compensation value is used with any given roll output signal to display a modified roll value.

48. The apparatus of claim 46 wherein said receiver prompts said operator to cause the receiver to enter a procedure in which said roll compensation flag is cleared such that any given roll output signal is then used to produce an unmodified roll value which is the roll orientation of said assembly.

49. The apparatus of claim 48 wherein said receiver indicates a current status of the roll compensation flag to an operator of the receiver.

50. The apparatus of claim 49 wherein said receiver indicates at least one of an unmodified roll position of the leading arrangement when the roll compensation flag is cleared and a modified roll position of the leading arrangement is indicated when the roll compensation flag is set.

51. The apparatus of claim 46 including determining a current roll orientation of the leading arrangement based on said roll compensation value when said roll compensation flag is set.

52. The apparatus of claim 46 wherein said receiver determines a current roll orientation of the leading arrangement, irrespective of said roll compensation value, when said roll compensation flag is in the cleared state.

53. The apparatus of claim 46 wherein said receiver tests said roll compensation flag and, thereafter, responsive to said testing, indicates one of a current roll orientation of the assembly using a current roll output signal or indicates a current roll position of the leading arrangement using the current roll output signal in conjunction with the angular offset value.

* * * * *